US007697699B2

(12) United States Patent
Ozawa

(10) Patent No.: US 7,697,699 B2
(45) Date of Patent: Apr. 13, 2010

(54) METHOD OF AND APPARATUS FOR REDUCING NOISE

(75) Inventor: Kazuhiko Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 1402 days.

(21) Appl. No.: 11/103,116

(22) Filed: Apr. 11, 2005

(65) Prior Publication Data

US 2005/0234715 A1 Oct. 20, 2005

(30) Foreign Application Priority Data

Apr. 12, 2004 (JP) ..... 2004-117248

(51) Int. Cl.
*G10L 21/02* (2006.01)

(52) U.S. Cl. ..... 381/94.1; 381/73.1; 381/122; 381/123

(58) Field of Classification Search ..... 381/94, 381/94.1, 92, 73.1, 91, 122, 111, 113, 119, 381/123
See application file for complete search history.

(56) References Cited

U.S. PATENT DOCUMENTS

| | | | | |
|---|---|---|---|---|
| 4,335,322 | A * | 6/1982 | Tanaka et al. | 327/310 |
| 5,243,661 | A * | 9/1993 | Ohkubo et al. | 381/94.2 |
| 5,485,524 | A * | 1/1996 | Kuusama et al. | 381/94.3 |
| 6,690,805 | B1 * | 2/2004 | Tsuji et al. | 381/94.1 |
| 7,054,452 | B2 * | 5/2006 | Ukita | 381/92 |
| 2002/0116178 | A1 | 8/2002 | Crockett | |

FOREIGN PATENT DOCUMENTS

| | | |
|---|---|---|
| JP | 57-148413 | 9/1982 |
| JP | 62-42197 | 2/1987 |
| JP | 63-2500 | 1/1988 |
| JP | 5-14989 | 1/1993 |
| JP | 5-276593 | 10/1993 |

(Continued)

OTHER PUBLICATIONS

Akbari Azirani A et al: "Optimizing speech enhancement by exploiting masking properties of the human ear" Acoustics, Speech, and Signal Processing, 1995. ICASSP-95., 1995 International Conference on Detroit, MI, USA May 9-12, 1995, New York, NY, USA,IEEE, US, vol. 1, May 9, 1995, pp. 800-803, XP010625354 ISBN: 0-7803-2431-5.

(Continued)

*Primary Examiner*—Xu Mei
*Assistant Examiner*—Daren Vaughn
(74) *Attorney, Agent, or Firm*—Frommer Lawrence & Haug LLP; William S. Frommer

(57) ABSTRACT

An apparatus for reducing noise includes a comparator for generating a noise timing signal corresponding to a noise producing period of noise introduced from a noise source and contained in an audio signal, a gap time generator for generating a gap period in which to remove noise from the audio signal, a selector switch for selectively outputting the audio signal and a noise-removed signal, a level detector for detecting a signal level of the audio signal, and a masking degree determining unit for determining from the signal level detected by the level detector a gap period for which the audio signal is masked by the human auditory system. The selector switch outputs the noise-removed signal in a period corresponding to the gap period within the noise producing period of the noise timing signal, and outputs the audio signal in other than the gap period.

22 Claims, 13 Drawing Sheets

FOREIGN PATENT DOCUMENTS

| | | | | |
|---|---|---|---|---|
| JP | 05276593 | A | * | 10/1993 |
| JP | 7-311903 | | | 11/1995 |
| JP | 8-124299 | | | 5/1996 |
| JP | 8-153365 | | | 6/1996 |
| JP | 2002-74673 | | | 3/2002 |
| JP | 2002-251823 | | | 9/2002 |
| JP | 2005057437 | A | * | 3/2005 |
| JP | 2000-278786 | | | 10/2008 |
| WO | WO 02 098169 | | | 12/2002 |

OTHER PUBLICATIONS

Strope B et al: "A Model of Dynamic Auditory Perception and Its Application to Robust Word Recognition" IEEE Transactions on Speech and Audio Processing, IEEE Inc. New York, US, vol. 5, No. 5, Sep. 1997, pp. 451-464, XP000774305 ISSN: 1063-6676.

Vafin R et al: "Exploiting time and frequency masking in consistent sinusoidal analysis-synthesis" Acoustics , Speech, and Signal Processing, 2000. ICASSP '00. Proceedings. 2000 IEEE International Conference on Jun. 5-9, 2000, Piscataway, NJ, USA,IEEE, vol. 2, Jun. 5, 2000, pp. 901-904, XP010504869 ISBN: 0-7803-6293-4.

Moore B C J, Glasberg B R: "Growth of forward masking for sinusoidal and noise maskers as a function of signal delay; implications for suppression in noise" Journal of the Acoustical Society of America, vol. 73, No. 4, Apr. 1983, pp. 1249-1259, XP009048757 p. 1251-1253, Section "II. Experiment II".

* cited by examiner

TARGET NOISE SIGNAL

SENSOR OUTPUT SIGNAL

NOISE-REDUCED SIGNAL

METHOD OF AND APPARATUS FOR REDUCING NOISE

BACKGROUND OF THE INVENTION

The present invention relates to a method of and an apparatus for reducing noise when recording an audio signal by a small-size microphone that is incorporated in a digital consumer electronics device.

Growing efforts have in recent years been made to reduce the size of digital consumer electronics apparatus incorporating a small-size microphone in their cabinet, e.g., video cameras, digital cameras, IC recorders, etc. Because of the small size of those digital consumer electronics apparatus, the user tends to inadvertently touch the microphone or noise is likely to propagate through the cabinet to the microphone when various functional switches are clicked during a recording mode. Therefore, when in a reproducing mode, undesirable touch noise or click noise may possibly be reproduced from the apparatus. Furthermore, since the microphone is positioned closely to a recording device such as a tape device or a disk device housed in the cabinet, vibration noise or sound noise produced by the recording device is highly likely input to the microphone.

In order to reduce the regenerated noise, it has heretofore been attempted to absorb vibrations transmitted from the cabinet and prevent them from being applied to the microphone unit by floatingly supporting the microphone unit of the incorporated microphone with an insulator such as a rubber damper or the like or suspending the microphone unit in the air with a rubber wire or the like. However, these structures are not effective enough to suppress all the vibrations. When strong vibrations are applied or depending on the vibration frequency, the insulator is ineffective or may resonate at an inherent frequency. These proposed structures are difficult to design, and the design difficulty is responsible for obstacles to efforts to reduce the cost and size.

Other noise reduction proposals have also been made (see Patent Documents 1 through 5 below). The noise that is picked up by the microphone unit is caused by not only vibrations transmitted through the cabinet, but also sounds propagated through the air. Since the noise is transmitted through complex paths to the microphone unit, the conventional passive noise reduction techniques are subject to limitations and have not reached a level that the user satisfies.

Patent Document 1: Japanese Patent Laid-open No. 2002-74673;

Patent Document 2: Japanese Patent Laid-open No. 2002-251823;

Patent Document 3: Japanese Patent Laid-open No. Hei 8-124299;

Patent Document 4: Japanese Patent Laid-open No. Hei 7-311903; and

Patent Document 5: Japanese Patent Laid-open No. Hei 8-153365.

The applicant of the present application has proposed noise reduction processes as disclosed in Japanese patent application No. 2002-367234 (Noise reduction apparatus and method) and Japanese patent application No. 2003-285294 (microphone device, noise reduction method, and recording device). According to these prior applications, an adaptive filter is used to generate a pseudo-noise signal, and the pseudo-noise signal is subtracted from an audio signal including noise, thereby reducing the noise.

The adaptive filter that is used tends to require a greater number of taps as the noise signal to be approximated is in a wider frequency band and is continued for a longer time interval. For example, if a noise waveform for a time interval of 10 ms is to be approximated in a frequency band up to the Nyquist frequency at a sampling frequency of 48 kHz, then an adaptive filter having about 480 taps is required.

Since as many product-sum operations as several times the number of taps is needed per sample for processing the data, the overall amount of processing operations is increased, requiring a piece of hardware such as a large logic circuit or a high-speed DSP (Digital Signal Processor). A time delay caused by the processing operations that are required cannot be ignored, resulting in a need for simultaneously delaying the audio signal. Accordingly, desired sounds cannot be recorded in real time.

The present invention has been made in view of the foregoing problems. According to the present invention, the adaptive filter disclosed in the prior applications is not employed, but a human auditory masking effect is utilized to effectively reduce noise through a reduced amount of processing operations without causing any substantial signal delay.

The noise that is to be reduced by the present invention is instantaneous noise caused by vibrations, such as touch noise and click noise referred to above. The vibration noise produced by the recording unit is also instantaneously produced noise such as a seeking sound produced by a magnetic head or an optical pickup in the disk unit, but not noise that is produced at all times by a spindle motor. The differences between the prior art, referred to as Patent Documents 1 through 5, and the present invention will be described below.

Patent Document 1 discloses an audio recording apparatus for recording an audio signal from a microphone while reducing, from the audio signal, noise that is generated when an optical pickup moves over a disk recording medium. Though Patent Document 1 is aimed at solving the same problem as the present invention, it does not utilize a human auditory masking effect according to the present invention.

Patent Document 2 discloses a continuous information recording apparatus for cutting off or reducing noise produced in a seek mode of a disk unit from an audio signal produced by a sound pickup. According to the disclosed continuous information recording apparatus, audio data in a cutoff period is approximately interpolated from signal data prior and subsequent to the cutoff period in order to keep the audio signal continuous. According to the present invention, however, no interpolating circuit is required as no interpolation is performed, and a cutoff period is variable utilizing a human auditory masking effect.

Patent Document 3 discloses an audio recording and reproducing apparatus for reducing noise by replacing audio data in a period containing noise from a movable section with interpolated data that is predicted from audio data prior and subsequent to the period. According to the present invention, however, no interpolating circuit is required as no interpolation is performed.

Patent Document 4 discloses a microphone-contained magnetic recording apparatus for reducing audio signal noise produced when a magnetic head of a camera-combined VTR hits a tape by pre-holding an audio signal in a noise producing period or switching to a signal with a noise band trapped therefrom. According to the present invention, data in a cutoff period does not need to be interpolated as a human auditory masking effect is utilized.

Patent Document 5 discloses a microphone-contained magnetic recording apparatus which reduces audio signal noise produced when a magnetic head of a camera-combined VTR hits a tape only when the audio signal level is lower than a reference level. According to the present invention, a cutoff period is variable utilizing a human auditory masking effect.

The above prior art mainly serves to reduce rotation noise produced from drum-type magnetic recording apparatus and seek noise produced from disk-type recording apparatus. The present invention is additionally aimed at reducing touch noise and click noise because it has a sensor for detecting noise.

SUMMARY OF THE INVENTION

According to the present invention, there is provided an apparatus for reducing noise in an input audio signal, including at least one audio signal inputting section, a noise timing generator for generating a noise timing signal corresponding to a noise producing period of noise introduced from a noise source and contained in the audio signal, a noise remover for removing the noise from the audio signal, a switch for selectively outputting the audio signal and a signal from the noise remover, a level detector for detecting a signal level of the audio signal, and a masking degree determining unit for determining a gap period for which the audio signal is masked by the human auditory system from the signal level detected by the level detector. The switch outputs the signal from the noise remover in a period corresponding to the gap period within the noise producing period of the noise timing signal, and outputs the audio signal in other than the gap period.

According to the present invention, there is also provided a method of reducing noise in an input audio signal, including the steps of generating a noise timing signal corresponding to a noise producing period of noise introduced from a noise source and contained in at least one audio signal, removing the noise from the audio signal, selectively outputting the audio signal and a signal from the noise removing step, detecting a signal level of the audio signal, and determining from the signal level detected by the signal level detecting step a gap period for which the audio signal is masked by the human auditory system. The selectively outputting step outputs the signal from the noise removing step in a period corresponding to the gap period within the noise producing period of the noise timing signal, and outputs the audio signal in other than the gap period.

With the above arrangement, when instantaneous noise, e.g., shock noise or seek noise, produced in a recording mode of a digital consumer electronics device incorporating a small-size microphone is gated off from an audio signal from the microphone, a gap time in which to gate off the instantaneous noise is controlled so that no reproducing failure occurs even if the audio signal is also simultaneously gated off, based on the human auditory masking effect. As noise is simply gated off only during a noise producing period according to the human auditory masking effect, unlike a noise reduction process using an adaptive filter as disclosed in prior applications Nos. 2002-367234 and 2003-285294, the noise reduction process according to the present invention requires a reduced circuit scale and cost, and can easily be carried out.

According to the present invention, there is further provided an apparatus for reducing noise in an input audio signal, including at least one audio signal inputting section, a band divider for dividing the audio signal into a plurality of audio signals in respective bands, a noise timing generator for generating a noise timing signal corresponding to a noise producing period of noise introduced from a noise source and contained in the audio signals from the band divider, a plurality of a noise remover for removing the noise from the audio signals, respectively, a plurality of a switch for selectively outputting the audio signal and signals from the noise remover, a plurality of a level detector for detecting signal levels of the audio signals, and a plurality of a masking degree determining unit for determining, from the signal levels detected by the level detector, gap periods for which the audio signals are masked by the human auditory system. The switch outputs the signals from the noise remover in periods corresponding to the gap periods within the noise producing period of the noise timing signal, and outputs the audio signal in other than the gap periods, the audio signals in the respective bands are added into a sum signal, and the sum signal is outputted.

According to the present invention, there is further a method of reducing noise in an input audio signal, including the steps of dividing at least one audio signal into a plurality of audio signals in respective bands, generating a noise timing signal corresponding to a noise producing period of noise introduced from a noise source and contained in the audio signals from the dividing step, removing the noise from the audio signals, selectively outputting the audio signal and signals from the noise removing step, detecting signal levels of the audio signals, and determining, from the signal levels detected by the level detecting step, gap periods for which the audio signals are masked by the human auditory system. The selectively outputting step outputs the signals from the noise removing step in periods corresponding to the gap periods within the noise producing period of the noise timing signal, and outputs the audio signal in other than the gap periods, adds the audio signals in the respective bands into a sum signal, and outputs the sum signal.

With the above arrangement, since the audio signal is divided into a plurality signals in respective bands, gap periods for masking the audio signals are determined in the respective bands, the noise is removed, and the audio signals in the respective bands are combined together, masking degrees can be determined and optimized in the respective bands for noise reduction. For a divided band that can easily be masked, the gap period can further be increased to advantage. For a divided band free of noise, no noise needs to be gated off, resulting in higher efficiency.

According to the present invention, there is also provided an apparatus for reducing noise in an input audio signal, including a plurality of microphones, a processing section for outputting a differential component between a plurality of audio signals from the microphones, a noise extractor for extracting noise introduced from a noise source and contained in an output signal from the processing section, a noise timing generator for generating a noise timing signal corresponding to a noise producing period of the noise, a noise remover for removing the noise from the audio signals, a switch for selectively outputting the audio signal and a signal from the noise remover, a level detector for detecting a signal level of the audio signals, and a masking degree determining unit for determining from the signal level detected by the level detector a gap period for which the audio signals are masked by the human auditory system. The switch outputs the signal from the noise remover in a period corresponding to the gap period within the noise producing period of the noise timing signal, and outputs the audio signals in other than the gap period.

According to the present invention, there is also provided a method of reducing noise in an input audio signal, including the steps of outputting a differential component between a plurality of audio signals from a plurality of microphones, extracting noise introduced from a noise source and contained in an output signal from the processing step, generating a noise timing signal corresponding to a noise producing period of the noise, removing the noise from the audio signals, selectively outputting the audio signal and a signal from the noise removing step, detecting a signal level of the audio signal, and determining from the signal level detected by the level detector a gap period for which the audio signals are masked by the human auditory system. The selectively outputting step outputs the signal from the noise removing step in a period corresponding to the gap period within the noise producing period of the noise timing signal, and outputs the audio signals in other than the gap period.

In a small-size device incorporating a plurality of microphones, such microphones are positioned closely to each other. Noise signals that are picked up by the microphone due to noise produced in the device in addition to audio signals picked up by the microphones are less correlated to each other than the audio signals. Therefore, the noise signals can be extracted without the need for a sensor when a differential component between the noise signals is calculated. Since the noise can be reduced by detecting the period in which the extracted noise is detected, noise-reduced audio signals in right and left channels can be obtained by switching to the signal from the noise remover only when the noise is generated.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Digital consumer electronics apparatus incorporating a small-size microphone in their cabinet, e.g., video cameras, digital cameras, etc. are becoming smaller and smaller in size in recent years. Therefore, the recording/reproducing device, which includes a tape device or a disk device, in such an apparatus is positioned closely to the microphone, and tends to apply mechanical shock noise produced thereby easily to the microphone. Because of the small size of digital consumer electronics apparatus, when the user operates a zooming or focusing controller or any of various functional switches while in a camera exposure mode, it is often for the user to inadvertently touch a cabinet area near the microphone, causing noise to propagate through the cabinet to the microphone. Therefore, when in a reproducing mode, undesirable touch noise or click noise is possibly reproduced from the apparatus. While in the case the apparatus operates in the camera exposure mode in a relatively quiet place, since the sensitivity of the microphone is increased by an internal AGC (Automatic Gain Control) circuit, even slight touch noise or click noise when it is reproduced is annoying. Furthermore, as the microphone unit that is used generally has no directivity and is given directivity characteristics by a processing circuit, the level in the frequency band of noise is increased due to a proximity effect inherent in the directivity characteristics, tending to make the noise more noticeable than the desired audio signal.

In order to reduce the above-mentioned noise, it has heretofore been attempted to absorb vibrations transmitted from the cabinet and prevent them from being applied to the microphone by floatingly supporting the microphone unit with an insulator such as a rubber damper or the like or suspending the microphone unit in the air with a rubber wire or the like. However, these structures are not effective enough to suppress all the vibrations. When strong vibrations are applied or depending on the vibration frequency, the insulator is ineffective or may resonate at an inherent frequency. These proposed structures are difficult to design, and the design difficulty is responsible for obstacles to efforts to reduce the cost and size.

The noise such as the shock noise and the touch noise that is picked up by the microphone unit is caused by not only vibrations transmitted through the cabinet, but also sounds propagated through the air. Since the noise is transmitted through complex paths to the microphone, the conventional passive noise reduction techniques are subject to limitations and have not reached a level that the user satisfies.

Figure 1:
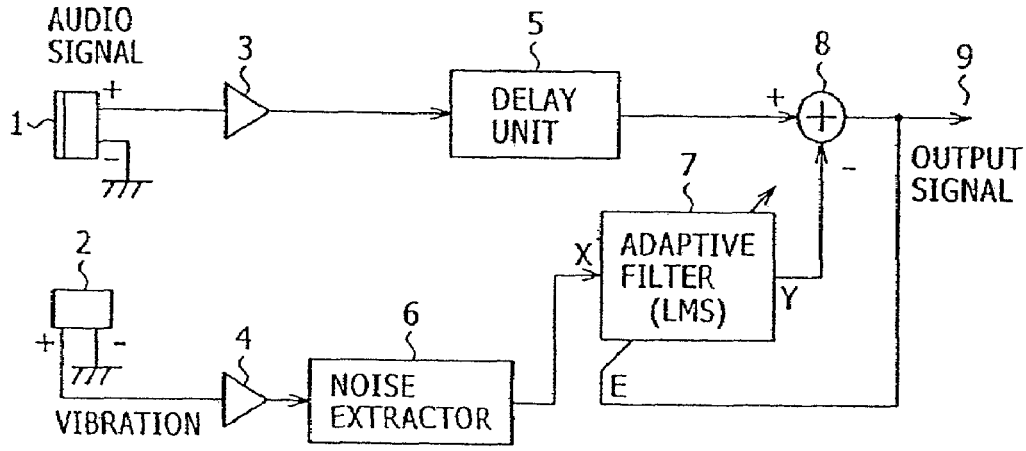
FIG. 1 RELATED ART
FIG. 1 is a block diagram of a noise reduction system incorporating an adaptive filter.

First, a noise reduction system incorporating an adaptive filter, which is disclosed in a prior application (Japanese patent application No. 2003-285294) will be described below with reference to FIG. 1. As shown in FIG. 1, a microphone 1, which may be any desired microphone unit, has a negative output terminal connected to the ground and a positive output terminal connected to an amplifier 3 for applying an output audio signal thereto. A sensor 2 has a negative output terminal connected to the ground and a positive output terminal connected to an amplifier 4. An output signal from the sensor 2 is amplified by the amplifier 4 and supplied to a noise extractor 6, which extracts a noise component from the output signal. The noise extractor 6 includes an LPF (Low Pass Filter) and a BPF (Band Pass Filter) for extracting a vibration noise component in a vibration noise band. The extracted vibration noise component is input as a reference input signal X to an adaptive filter 7, which generates and outputs a pseudo-noise signal Y according to a predetermined adaptive algorithm.

The audio signal amplified by the amplifier 3 is delayed by a delay unit 5 for a period of time corresponding to processing delays caused by the noise extractor 6 and the adaptive filter 7, and then applied to a positive input terminal of an adder 8.

The pseudo-noise signal Y from the adaptive filter 7 is applied to a negative input terminal of an adder 8 and subtracted from the audio signal in-phase therewith by the adder 8. The adder 8 applies the difference signal to an output terminal 9, which outputs the differential signal as an output signal. The output signal is fed back as an error signal E to the adaptive filter 7. The adaptive filter 7 operates to minimize the error signal at all times, so that the output terminal 9 produces an audio signal with a reduced vibration noise component.

The adaptive filter 7 tends to require a greater number of taps as the noise signal to be approximated is in a wider frequency band and is continued for a longer time interval. For example, if a noise waveform for a time interval of 10 ms is to be approximated in a frequency band up to the Nyquist frequency at a sampling frequency of 48 kHz, then an adaptive filter having about 480 taps is required. Since as many product-sum operations as several times the number of taps is needed per sample for processing the data, the overall amount of processing operations is increased, requiring a piece of hardware such as a large logic circuit or a high-speed DSP (Digital Signal Processor). A time delay caused by the processing operations that are required cannot be ignored, resulting in a need for simultaneously delaying the audio signal. Accordingly, desired sounds cannot be recorded in real time.

Since shock noise and touch noise referred to above are not produced continuously over time, but produced only upon impact, it is generated generally in a time period ranging from several ms to several tens ms. According to the present invention, the adaptive filter disclosed in the prior applications is not employed, but a human auditory masking phenomenon is utilized to effectively reduce noise through a reduced amount of processing operations without causing any substantial signal delay.

A human auditory masking phenomenon will be described below. The human auditory system is unable to perceive a weaker sound signal that occurs together with a stronger sound signal, such that human voice is imperceptible in strong noise. This phenomenon is called human auditory masking and has been studied for a long time. Though it is known that the human auditory masking depends upon various properties such as pressure sound level, continued time, etc., detailed mechanisms thereof are still under investigation. The human auditory masking is roughly divided into frequency masking and time masking. The time masking is classified into simultaneous masking and nonsimultaneous masking (also called successive masking). At present, the human auditory masking is utilized in an adaptive transform acoustic coding process for compressing a CD (Compact Disc) audio signal to ⅕ through 1/10, for example.

The nonsimultaneous masking phenomenon that is mainly utilized in the present invention will be described below with reference to FIG. 6. An upper graph shown in FIG. 6 has a vertical axis representing the absolute value of a signal level and a horizontal axis representing time, and shows that a signal A is input at a predetermined level and, after a signal-free gap time G, a signal B is input at a predetermined level. At this time, the human hearing level is indicated in a lower graph shown in FIG. 6. Specifically, even after the signal A is eliminated, the human auditory system senses a remaining pattern of the signal A at a lower sensitivity level. This is called forward masking (FM) which makes the human auditory system insensitive to sounds in the hatched region. The human auditory system also suffers a lower sensitivity level immediately prior to a next signal B. This is called backward masking (BM) which makes the human auditory system insensitive to sounds in the hatched region.

Usually, the forward masking has a greater masking degree than the backward masking, and occurs for about several hundreds ms depending on the conditions. Under certain conditions, the time gap G shown in FIG. 6 is audibly imperceptible, but the signal A and the signal B are perceived as continuous sounds. As indicated by a research article (1963) written about gap detection by R. Plomp, an article written by Masayoshi Miura (Sony, JAS. Journal, November 1994), and "General auditory psychology" written by B. C. J. Moore, translated by Kengo Oogushi, Seishin Books, First Print, Apr. 20, 1994, 4th Chapter/Auditory system time resolution, the time gap is imperceptible in the range from several ms to several tens ms under the following conditions:

First condition: If the frequency bands of the signal A and the signal B are correlated to each other, then the gap length increases, or if the signal A and the signal B are kept continuous in terms of frequency, then the gap length increases.

Second condition: The gap length is greater if the signals are band signals than if the signals are of a single sine wave.

Third condition: Providing the level of the signal A and the level of the signal B are the same, if these levels are smaller than a certain level, then the gap length is greater, and if these levels are greater than that, or another, certain level, then the gap length remains unchanged.

Fourth condition: The gap length is greater if the level of the signal B is lower than the level of the signal A.

Fifth condition: The gap length is greater as the central frequencies of the signals are lower, and smaller as the central frequencies of the signals are higher.

According to the present invention, based on these detecting conditions for the gap length (these conditions will hereinafter be referred to as first through fifth masking conditions), shock noise, touch noise, and click noise are eliminated by controlling the gap length at a value that is less perceptible by the human auditory system.

Figure 6:
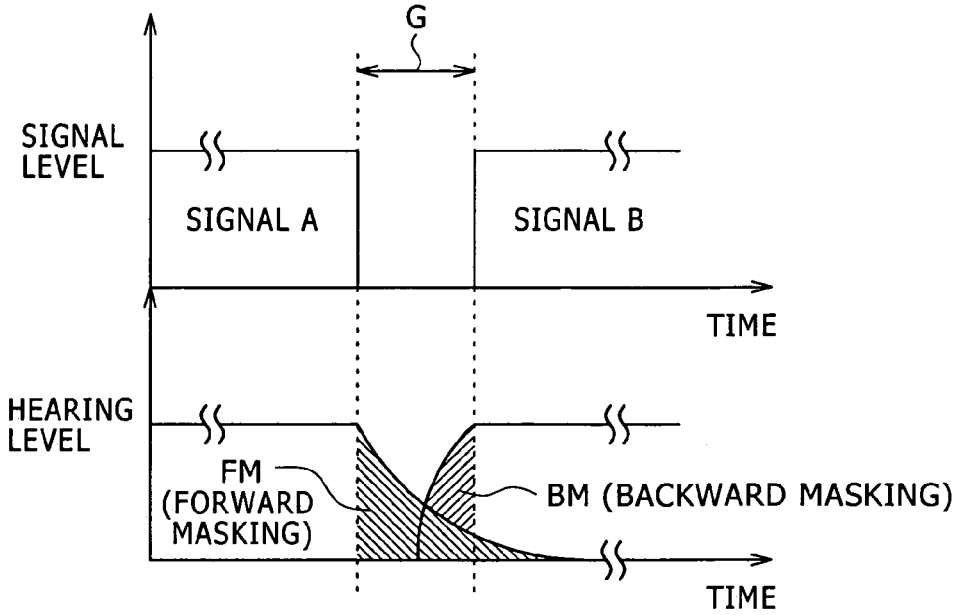
FIG. 6 is a diagram showing a first interpolation process based on asynchronous masking.
Figure 7:
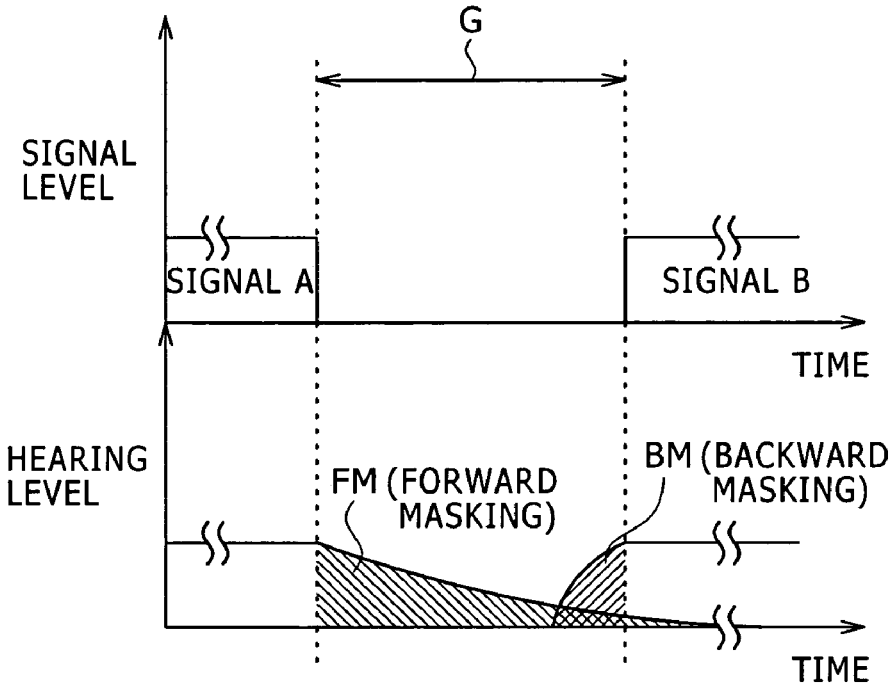
FIG. 7 is a diagram showing a second interpolation process based on asynchronous masking.
Figure 8:
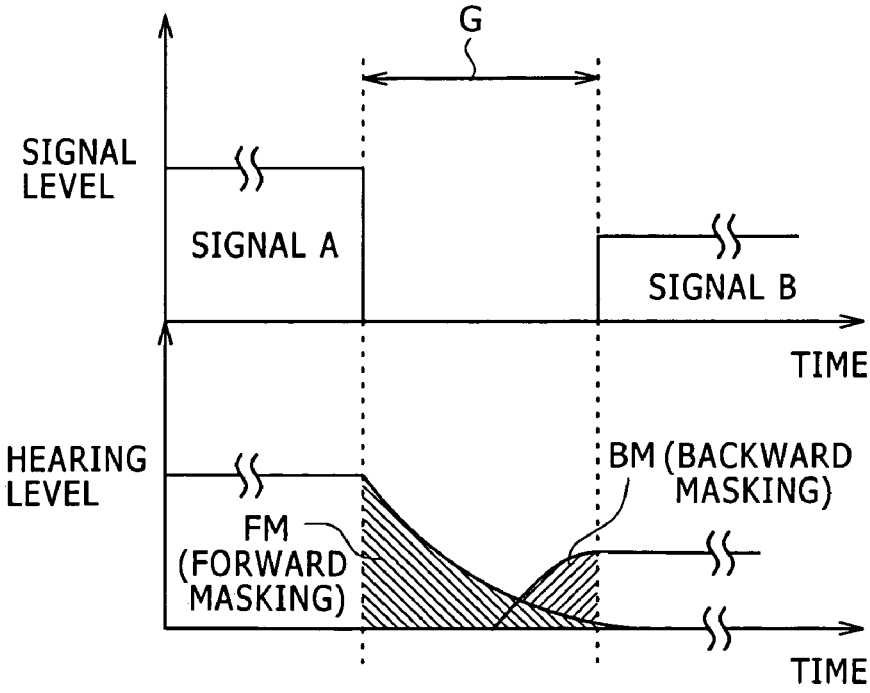
FIG. 8 is a diagram showing a third interpolation process based on asynchronous masking.

If the levels of the signals A, B are lower than those shown in FIG. 6 as shown in FIG. 7, then the gap length is relatively increased according to the third masking condition. If the level of the signal B is lower than the level of the signal A as shown in FIG. 8, then the gap length is relatively increased according to the fourth masking condition.

Figure 2:
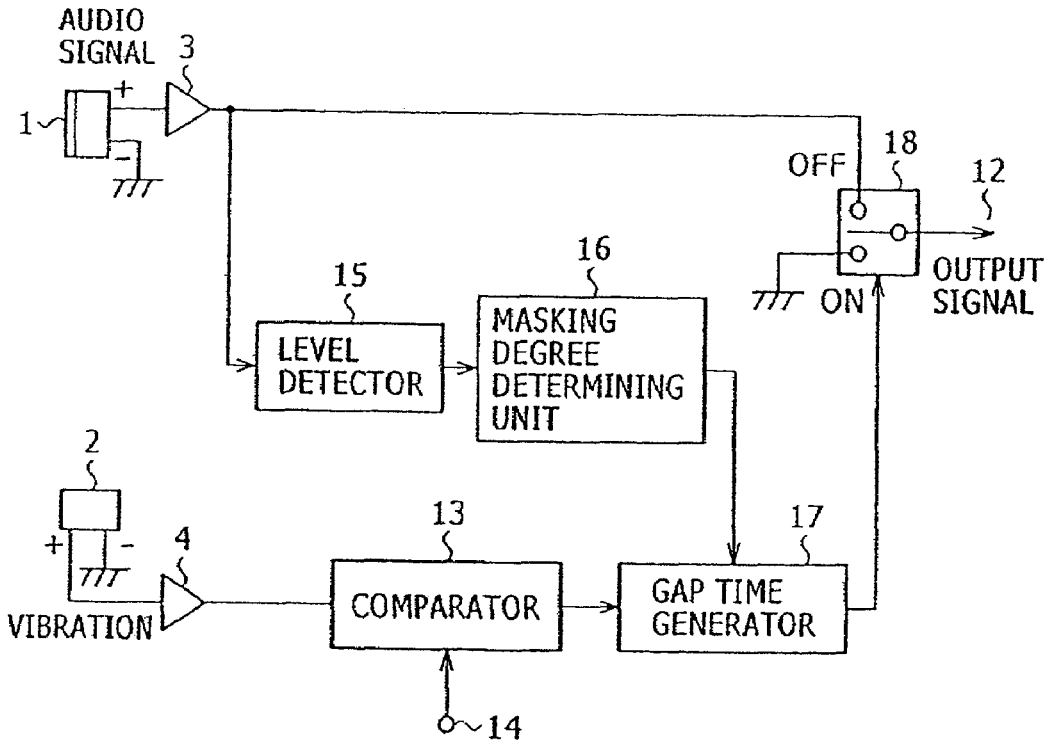
FIG. 2 is a block diagram of a first noise reduction system according to the present invention.

A first noise reduction system according to the present invention will be described below with reference to FIG. 2. As shown in FIG. 2, a microphone 1, which may be any desired microphone unit, has a negative output terminal connected to the ground and a positive output terminal connected to an amplifier 3 for applying an output audio signal thereto. A sensor 2 has a negative output terminal connected to the ground and a positive output terminal connected to an amplifier 4. The amplifier 4 applies an output signal to a comparator 13, which compares the applied output signal with the signal level of a reference level signal that is separately set from a terminal 14. The comparator 13 outputs a compared result to a gap time generator 17.

The amplifier 3 applies an output signal to an input terminal of a selector switch 18 whose other input terminal is grounded and also to a level detector 15, which detects the sound level of the output signal from the amplifier 3. A masking degree determining unit 16 determines a masking degree from the sound level detected by the level detector 15, and outputs the determined masking degree to the gap time generator 17. Depending on a gap length generated by the gap time generator 17, the selector switch 18 selects a signal, and the selected signal is output from a terminal 12.

Figure 3:
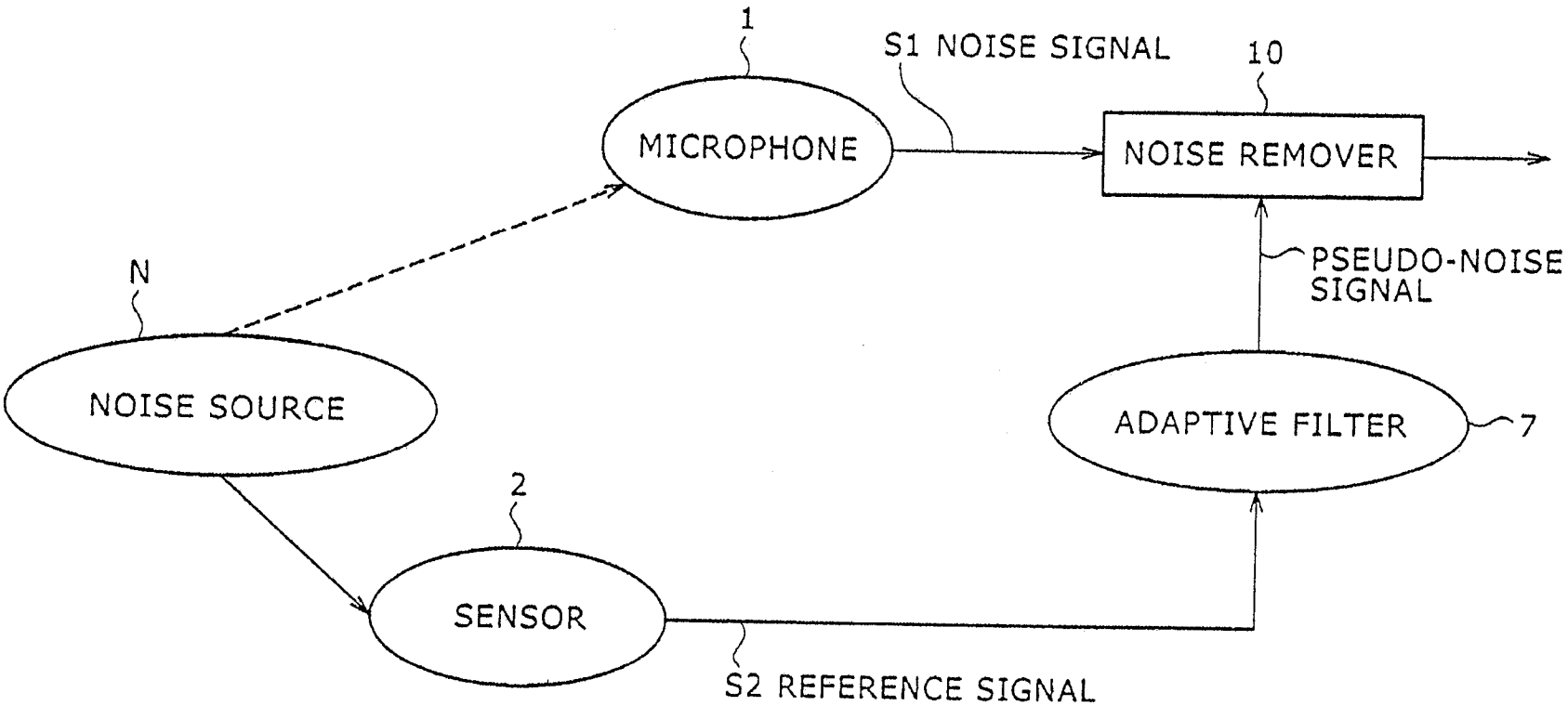
FIG. 3 RELATED ART
FIG. 3 is a block diagram illustrating a noise reduction process incorporating an adaptive filter.

The differences between the noise reduction system incorporating the adaptive filter shown in FIG. 1 and the noise reduction system according to the present invention shown in FIG. 2 will be described below with reference to FIGS. 3 and 4. FIG. 3 illustrates a noise reduction process incorporating an adaptive filter 7 as disclosed in the prior application. In FIG. 3, vibration and sound noise from a noise source N is applied to a microphone 1, which converts the noise into a noise signal S1. Simultaneously, a sensor 2 detects the vibration noise, and produces an output signal which is used as a reference signal S2 in an adaptive filter 7. The adaptive filter 7 generates a pseudo-noise signal that approximates the noise signal S1 from the reference signal S2. A noise remover 10 removes the pseudo-noise signal from the noise signal S1 for noise reduction.

Figure 4:
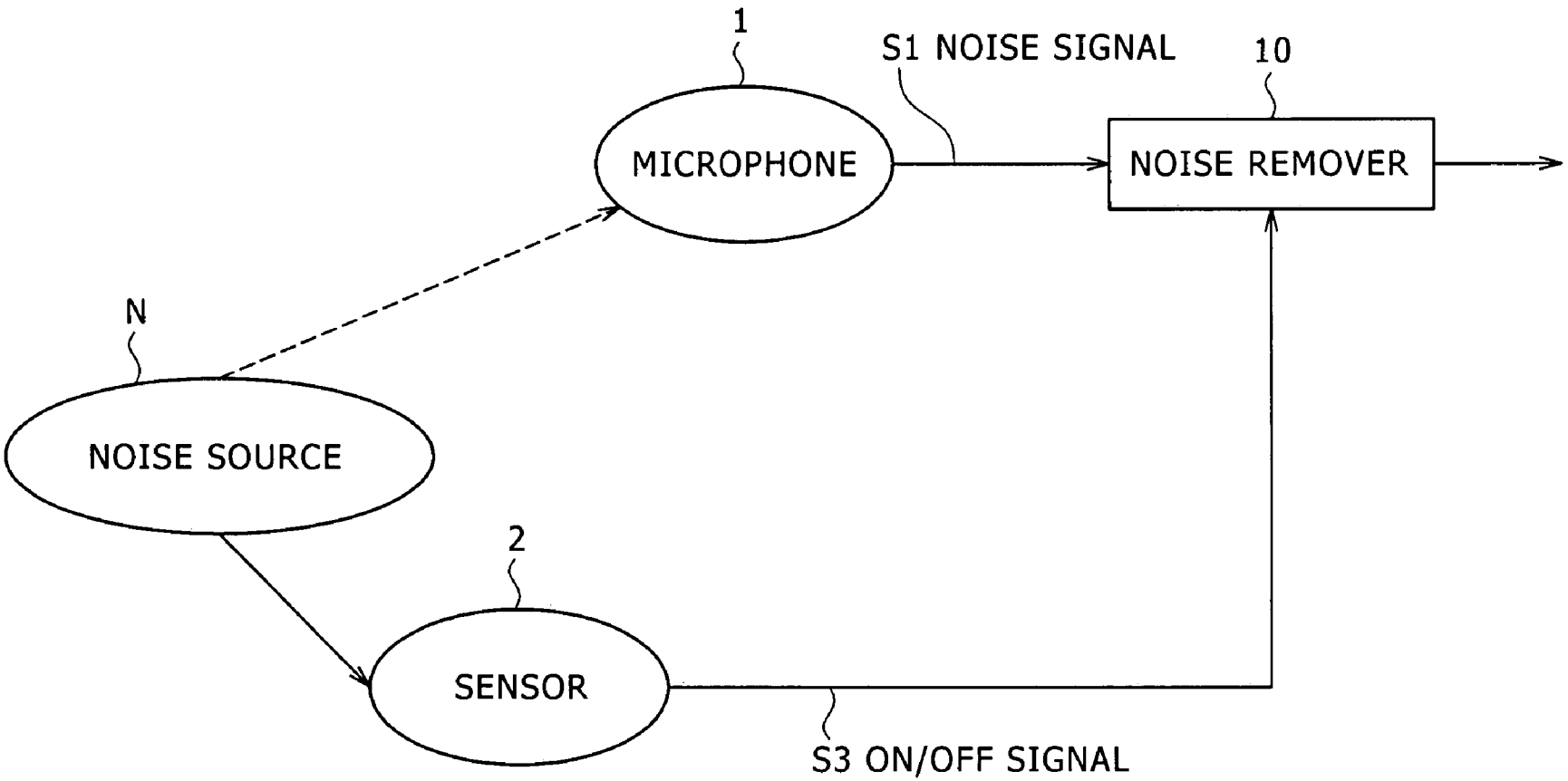
FIG. 4 is a block diagram illustrating a noise reduction process according to the present invention.

FIG. 4 is a block diagram illustrating a noise reduction process according to the present invention. As shown in FIG. 4, noise is applied to a microphone 1, which outputs a noise signal S1. The noise signal S1 is removed by a noise remover 10 only in a noise producing period detected by a sensor 2 for noise reduction. The noise reduction process according to the present invention can easily be implemented because it does not require an adaptive filter and the sensor 2 is only needed to output an ON/OFF signal S3.

Based on the above description of the noise reduction processes shown in FIGS. 3 and 4, operation of the first noise reduction system according to the present invention shown in FIG. 2 will be described below. The microphone 1 outputs a signal representing an audio signal mixed with a noise signal from the noise source. As described above, touch noise and click noise that are to be reduced according to the present invention are not produced continuously over time, but produced only upon impact. Therefore, when no impact is applied, the selector switch 18 is shifted to an OFF terminal connected to the amplifier 3 to allow the audio signal from the microphone 1 to be outputted as it is. Only when an impact is detected by the sensor 2, the selector switch 18 is shifted to an ON terminal connected to the ground to cut off the noise signal.

While the audio signal is also being simultaneously applied together with the noise signal, the audio signal is also cut off when the selector switch 18 is shifted to the ON terminal. According to the present invention, the level of the audio signal from the amplifier 3 is detected by the level detector 15. Based on the detected level, the masking degree determining unit 16 and the gap time generator 17 generate a gap time for which the audio signal is to be masked by the human auditory system, and the period of time for which the selector switch 18 is shifted to the ON terminal is controlled based on the gap time. If the level of the vibration signal output from the sensor 2 is greater than the level of the reference level signal from the terminal 14, then the comparator 13 determines that an impact is being applied. If the level of the vibration signal output from the sensor 2 is smaller than the level of the reference level signal from the terminal 14, then the comparator 13 determines that no impact is being applied.

If the level of the audio signal from the amplifier 3 is lower than a certain level, then the masking degree determining unit 16 increases the gap time according to the third masking condition. Alternatively, if the level of the audio signal from the amplifier 3 tends to decrease with time, then the masking degree determining unit 16 increases the gap time according to the fourth masking condition. In this manner, the masking degree determining unit 16 controls the gap time.

Figure 5:
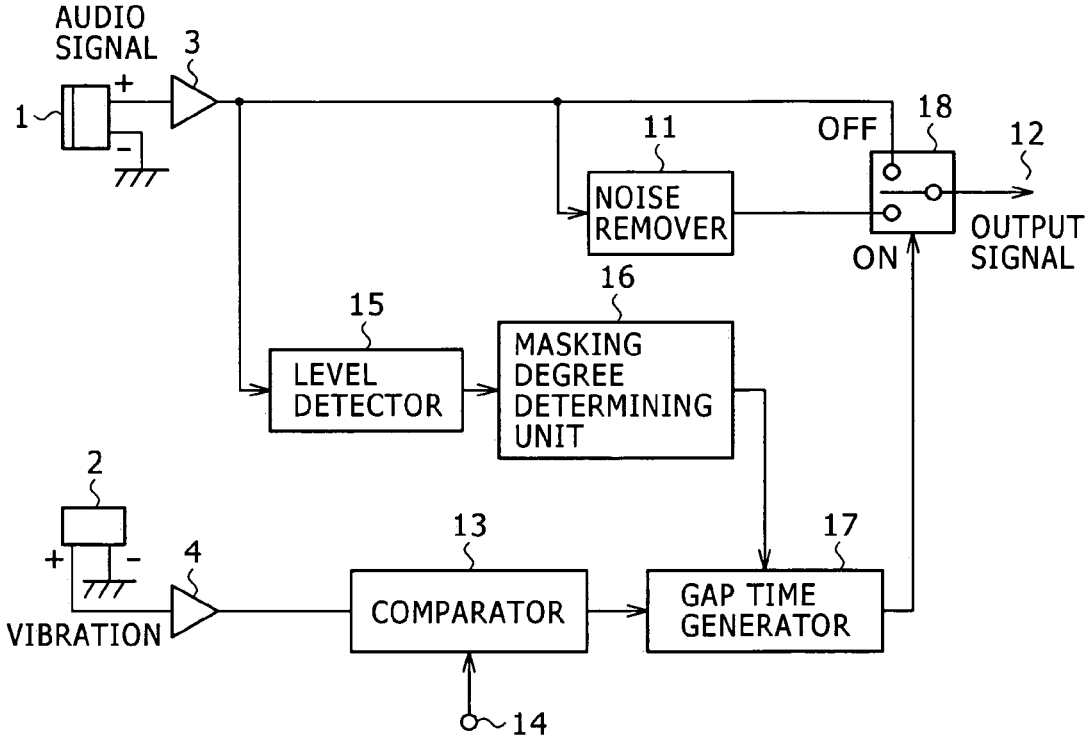
FIG. 5 is a block diagram of a second noise reduction system according to the present invention.

A second noise reduction system according to the present invention will be described below with reference to FIG. 5. Those functional blocks of the second noise reduction system shown in FIG. 5 which are identical to those of the first noise reduction system shown in FIG. 2 are denoted by identical reference characters, and will not be described in detail below. In FIG. 2, when an impact is applied, the selector switch 18 is shifted to the ON terminal connected to the ground to fully cut off the signal from the amplifier 3. In FIG. 5, when an impact is applied, the selector switch 18 is shifted to the ON terminal that is connected to a noise remover 11 which removes the noise band of the signal from the amplifier 3. The noise remover 11 includes a BEF (Band Elimination Filter) or the like, and operates at all times to cut off all the target noise frequency band.

In the noise reduction system shown in FIG. 5, only when an impact is applied, the selector switch 18 is shifted to the ON terminal for noise reduction, as with noise reduction system shown in FIG. 2. At this time, only the audio signal contained in the noise band is also removed. Since the signal A and the signal B are kept more continuous in terms of frequency than with noise reduction system shown in FIG. 2, the gap time due to masking can be increased for removing noise over a relatively long period of time, according to the above-mentioned first masking condition.

A third noise reduction system according to the present invention will be described below with reference to FIG. 9. Those functional blocks of the third noise reduction system shown in FIG. 9 which are identical to those of the second noise reduction system shown in FIG. 5 are denoted by identical reference characters, and will not be described in detail below. In the first and second noise reduction systems, a noise producing period is detected by the sensor 2. If such a noise producing period is known in advance, then a timing signal representative of the known noise producing period can be used to dispense with the sensor 2.

Figure 9:
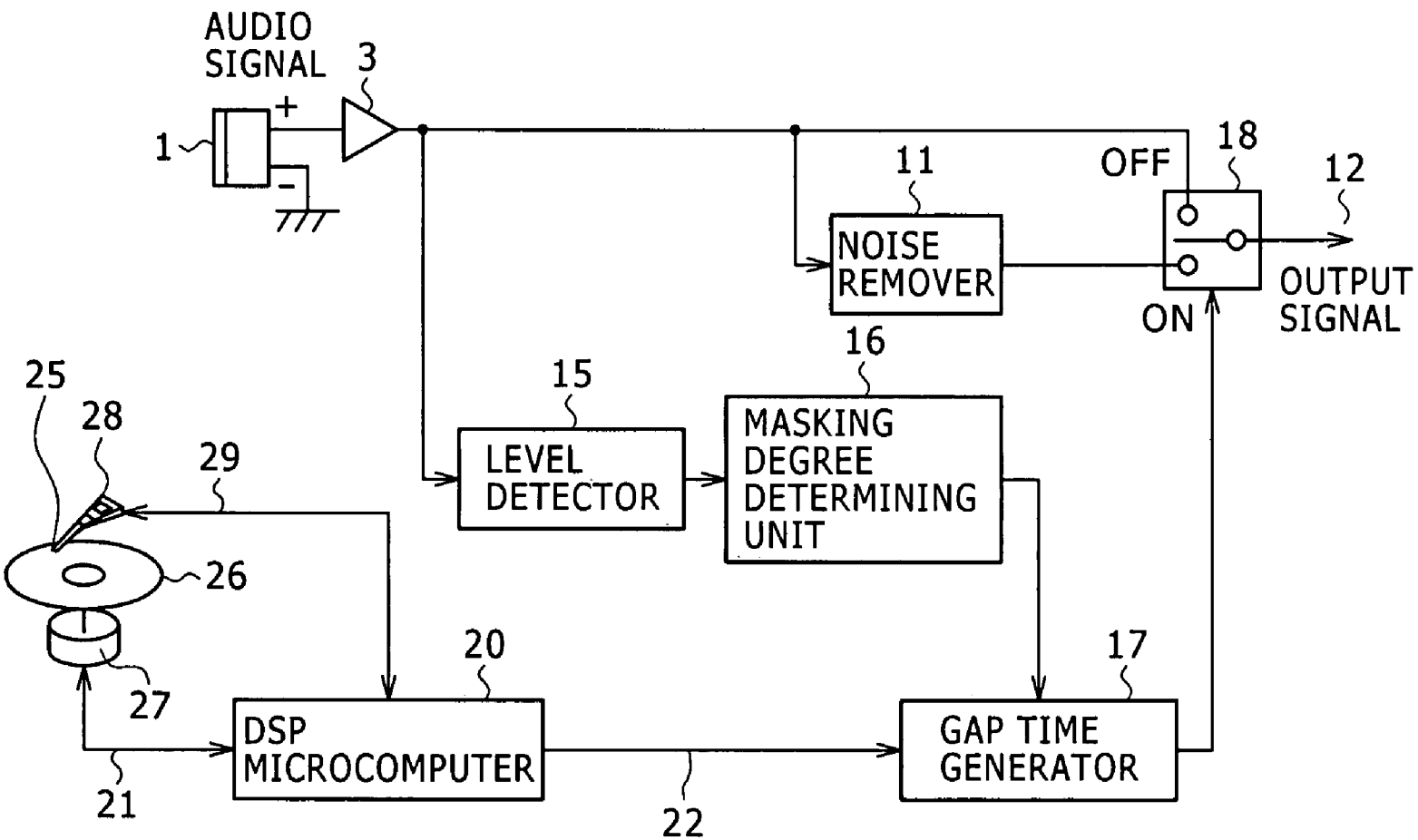
FIG. 9 is a block diagram of a third noise reduction system according to the present invention.

The third noise reduction system shown in FIG. 9 is aimed at reducing noise produced in a seek mode of a disk device such as a hard disk drive (HDD) or the like. The hard disk drive is constructed to read information from and write information on a magnetic film on the surface of a hard disk 26 with a magnetic head 25 that is attached to a voice coil motor (VCM) 28. The hard disk 26 is rotated at a predetermined rotational speed by a spindle motor 27 that is controlled by a servo signal 21 supplied from a digital signal processor (DSP) microcomputer 20.

The VCM 28 is controlled by a positional control signal 29 from the DSP microcomputer 20 to position the magnetic head 25 for reading data from and writing data on a certain location on the hard disk 26. Noise produced in the seek mode is caused by actuator vibrations that are generated when the VCM 28 quickly accelerates and decelerate the magnetic head 25 to reach the desired read/write location on the hard disk 26. In synchronism with the noise, the DSP microcomputer 20 outputs a noise timing signal 22 to the gap time generator 17 for noise reduction as with the first and second noise reduction systems shown in FIGS. 2 and 5.

Figure 10:
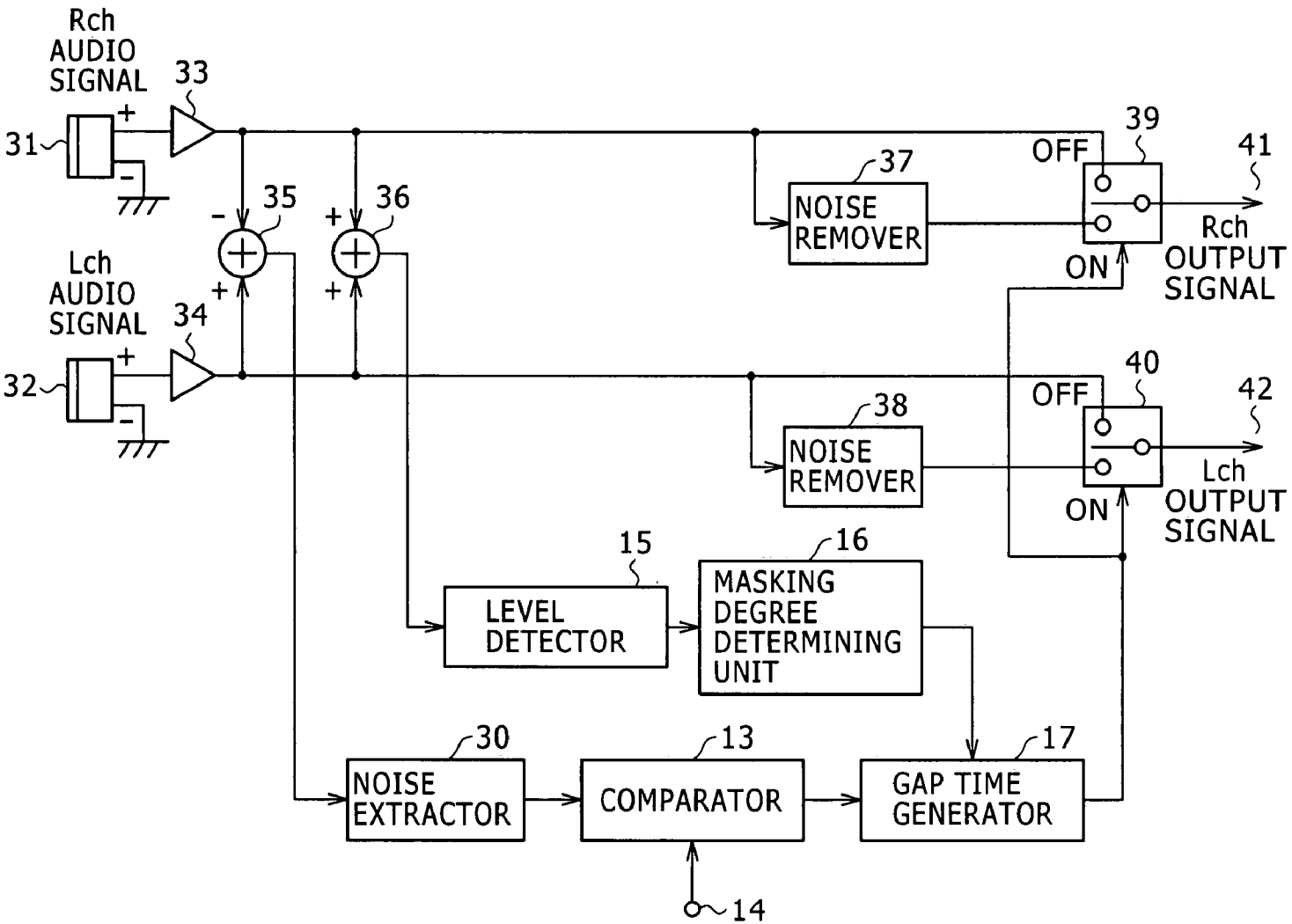
FIG. 10 is a block diagram of a fourth noise reduction system according to the present invention.

A fourth noise reduction system according to the present invention will be described below with reference to FIG. 10. Those functional blocks of the fourth noise reduction system shown in FIG. 10 which are identical to those of the second noise reduction system shown in FIG. 5 are denoted by identical reference characters, and will not be described in detail below. In the fourth noise reduction system, not only audio signals, but also noise signal components, are generated by a plurality of microphones to dispense with sensors. In FIG. 10, two microphones are used to record stereophonic sounds in two channels. As shown in FIG. 10, microphones 31, 32 are microphones in right and left channels, respectively, and apply respective output signals to amplifiers 33, 34 whose output signals are applied respectively to negative and positive input terminals of an adder 35. The adder 35 inputs a differential output signal through a noise extractor 30 to a comparator 13. The output signals from the amplifiers 33, 34 are added to each other by an adder 36, which inputs a sum signal to the level detector 15 for the same signal processing as with the first and second noise reduction systems.

The differential signal output from the adder 35, which represents the difference between the output signals from the microphones 31, 32, contains differential audio and noise signals caused by the different positions of the microphones 31, 32. It is assumed here that the fourth noise reduction system is incorporated in a video camera. A subject which is imaged by the video camera also serves as a sound source, which is mostly located remotely from the video camera at a distance significantly greater than the distance between the microphones 31, 32. However, a noise source is located within the video camera, and noise signals are caused due to different propagation paths from the noise source.

Audio signals that are applied to the microphones 31, 32 are highly correlated to each other because the microphones 31, 32 are positioned at relatively equal distances from the sound source, whereas noise signals are not less correlated to each other than the audio signals. When the audio and noise signals are subtracted one from the other by the adder 35, the audio signals cancel each other, but the noise signals do not, resulting in a large noise signal component. The noise signal component is applied to the noise extractor 30, whose output is applied to the comparator 13 to produce a noise timing signal. From the noise timing signal and the audio signal level generated by the level detector 15, the gap time generator 17 generates a gap time which is applied to selector switches 39, 40 to shift them to ON terminals connected to respective noise removers 37, 38 only when noise is generated. Therefore, when noise is generated, noise-reduced audio signals in the right and left channels are output from terminals 41, 42 connected to the respective selector switches 39, 40.

Figure 11:
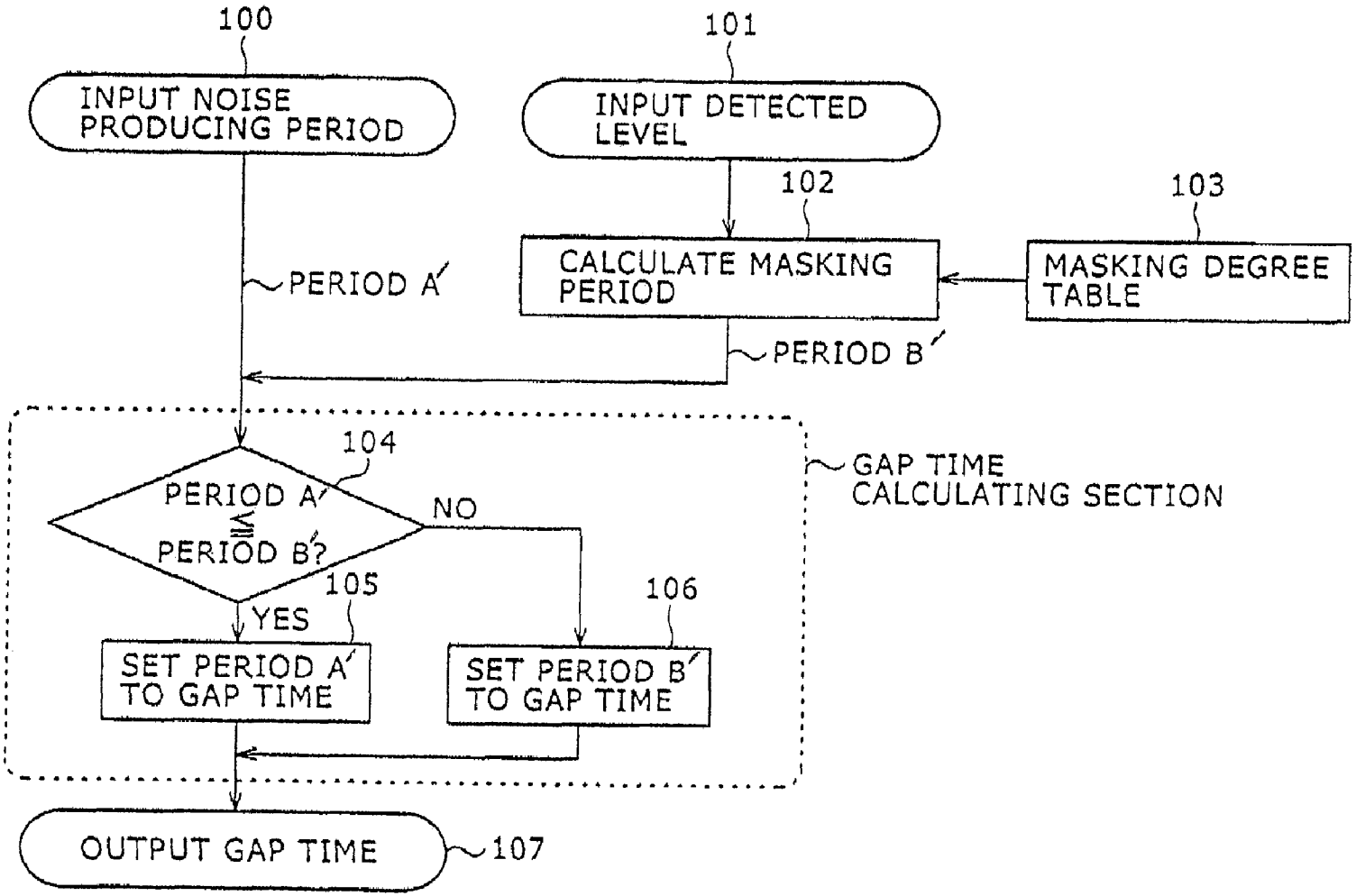
FIG. 11 is a flowchart of an operation sequence of a gap time generator.

An operation sequence of the gap time generator 17 for generating a gap time will be described below with reference to FIG. 11. In step 100, comparator 13 or DSP microcomputer 20 inputs noise producing period information represented by a period A'. In step 101, level detector 15 inputs a detected sound level. In step 102, a masking period B' depending on the detected sound level is calculated by referring to a table indicative of the relationship between sound levels and masking degrees which has been stored in a read-only memory (ROM) in step 103.

In step 104, it is determined whether or not the period A' is equal to or smaller than the masking period B'. If the period A' is equal to or smaller than the masking period B', then the period A' is set as a gap time in step 105, and output in step 107. If the period A' is greater than the masking period B', then the period B' is set as a gap time in step 106, and output in step 107. According to the present invention, therefore, noise is removed in a gap period for which the audio level is masked by the human auditory system.

A fifth noise reduction system according to the present invention will be described below with reference to FIG. 12. Those functional blocks of the fifth noise reduction system shown in FIG. 12 which are identical to those of the second noise reduction system shown in FIG. 5 are denoted by identical reference characters, and will not be described in detail below. In the first through fourth noise reduction systems, the frequency band of the audio signal from the microphone is handled as a single band and a masking degree is determined in the single band. In the fifth noise reduction system shown in FIG. 12, the frequency band of the audio signal from the microphone is divided into a plurality of bands, and a masking degree is determined in each of the bands to generate a gap time, so that the masking degree is optimized for noise reduction according to the fifth masking condition.

Figure 12:
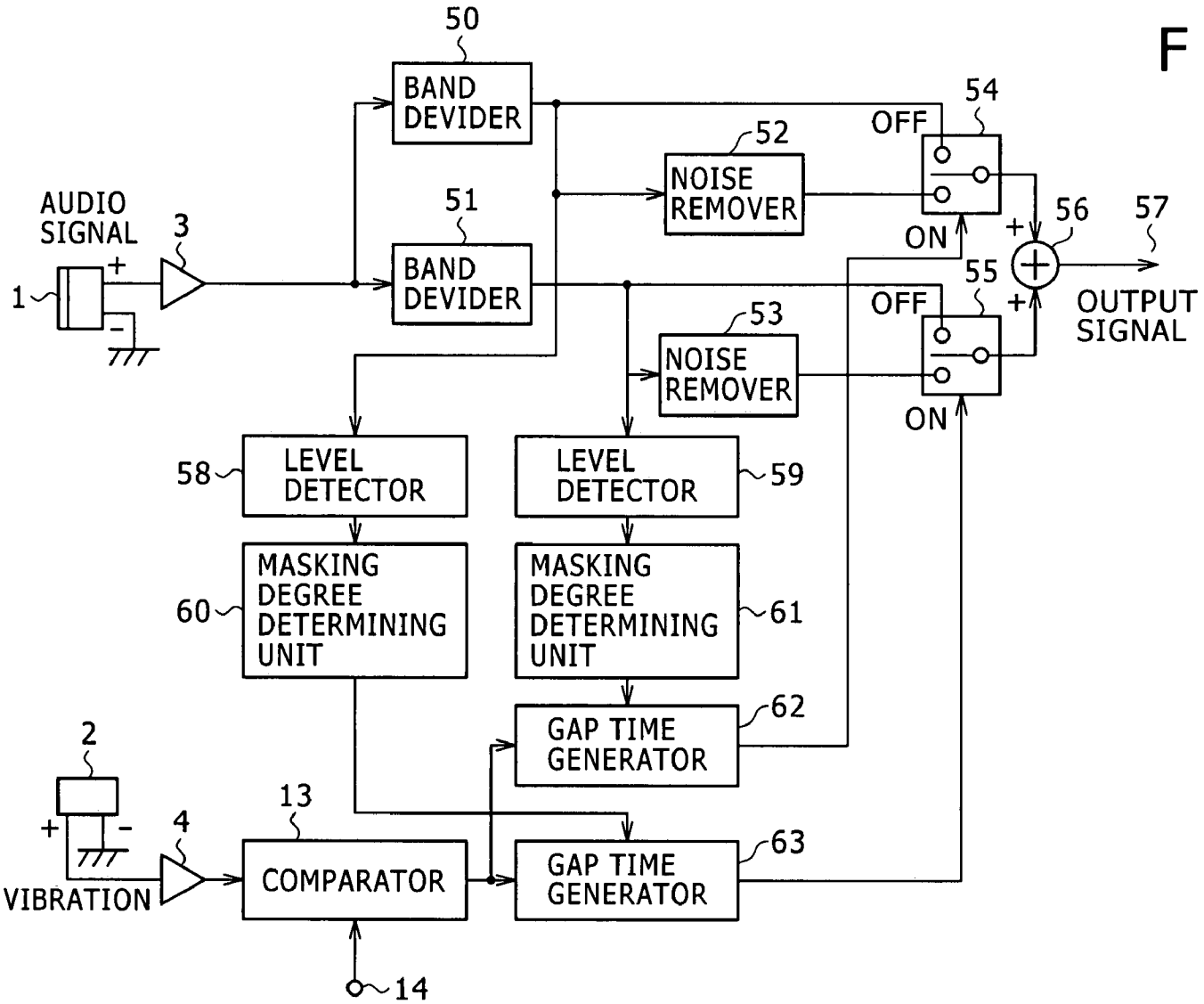
FIG. 12 is a block diagram of a fifth noise reduction system according to the present invention.

As shown in FIG. 12, an audio signal from the microphone 1 is input to through the amplifier 3 to both band dividers 50, 51. It is assumed here that the audio frequency band is divided into two bands, i.e., a high band and a low band. Divided band signals from the band dividers 50, 51 are independently input to selector switches 54, 55, noise removers 52, 53, and level detectors 58, 59 for the same signal processing as with the second noise reduction system shown in FIG. 5. A noise timing signal generated by the comparator 13 based on a signal from the sensor 2 is applied to gap time generators 62, 63. Based on the noise timing signal and masking degrees determined by masking degree determining units 60, 61 which are supplied with detected levels from the level detectors 58, 59, the gap time generators 62, 63 generate gap times. The generated gap times are supplied from the gap time generators 62, 63 to the selector switches 54, 55, which produce noise-reduced output band signals. The noise-reduced output band signals are added by an adder 56 into a combined-band signal, which is output from terminal 57.

Figure 13:
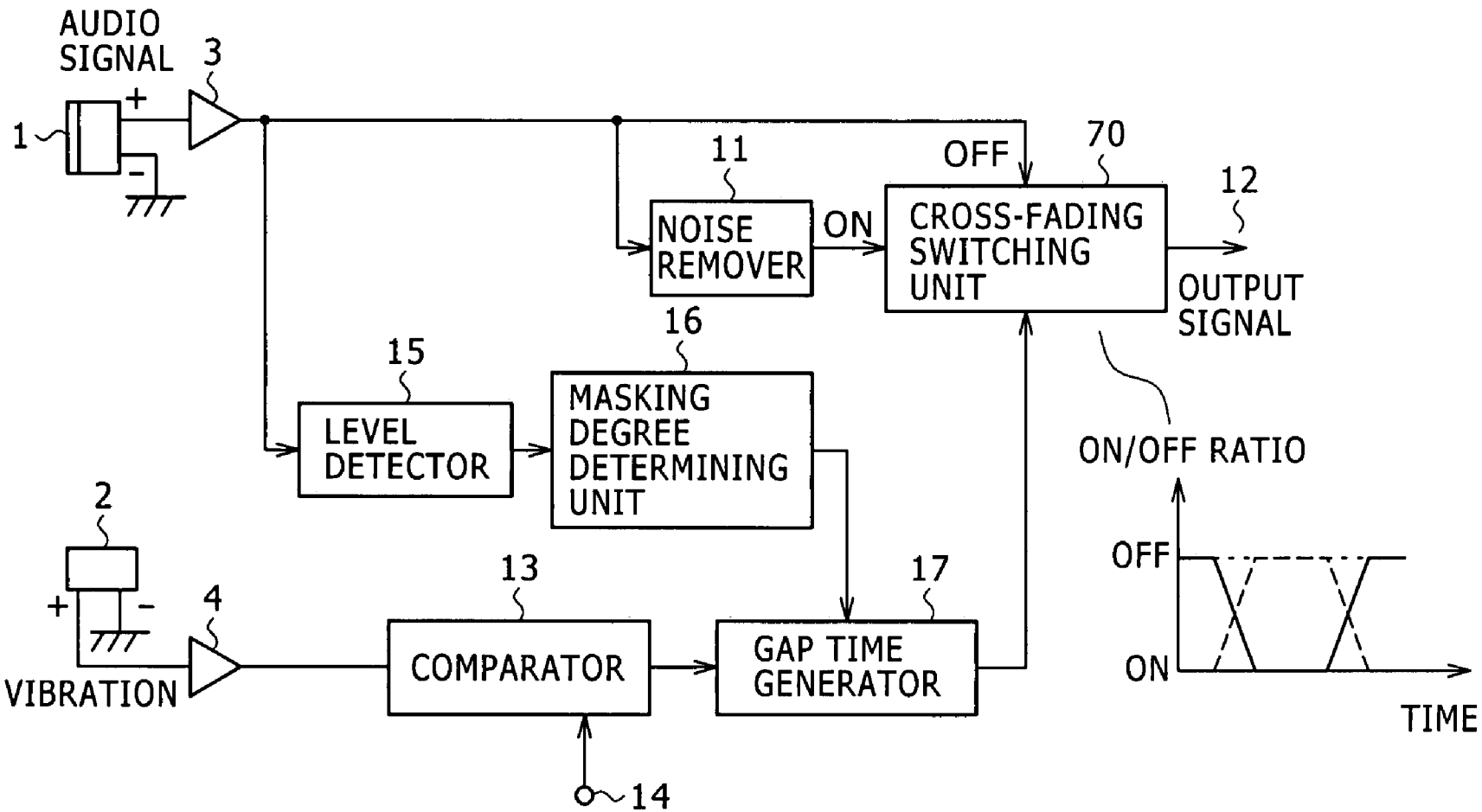
FIG. 13 is a block diagram of a sixth noise reduction system according to the present invention.

A sixth noise reduction system according to the present invention will be described below with reference to FIG. 13. Those functional blocks of the sixth noise reduction system shown in FIG. 13 which are identical to those of the second noise reduction system shown in FIG. 5 are denoted by identical reference characters, and will not be described in detail below. The sixth noise reduction system shown in FIG. 13 is different from the second noise reduction system shown in FIG. 5 in that the function of the selector switch 18 shown in FIG. 5 is performed by a cross-fading switching unit 70. The cross-fading switching unit 70 includes a multiplier whose multiplication coefficient is variable by an external signal. The cross-fading switching unit 70 has an ON/OFF ratio that can be changed with a time constant by the multiplication coefficient that is variable according to an ON/OFF signal from the gap time generator 17. The cross-fading switching unit 70 switches between ON and OFF states in a cross-fading fashion with a time constant as indicated by the solid- and broken-line curves in a reference figure of FIG. 13. Therefore, the output signal from the cross-fading switching unit 70 suffers no overshooting or ringing upon switching, and is not made wider in frequency band due to the generation of harmonic noise upon switching. The cross-fading switching unit 70 thus provides a better masking effect.

The noise reduction systems described above are given by way of illustrative example only, and may be modified in various ways. For example, three or more microphones may be employed, a plurality of sensors may be provided at a plurality of noise sources on a video camera, or the frequency band of an audio signal may be divided into narrower bands.

Furthermore, a time delay circuit such as the delay unit 5 shown in FIG. 1 may be added to delay the audio signal. For example, the delay unit 5 may be provided between the amplifier 3 and the switch 18 shown in FIG. 2 to bring the noise contained in the audio signal from the microphone 1 into reliable synchronism with the gap time generated by the gap time generator 17 for better noise reduction.

Figure 14:
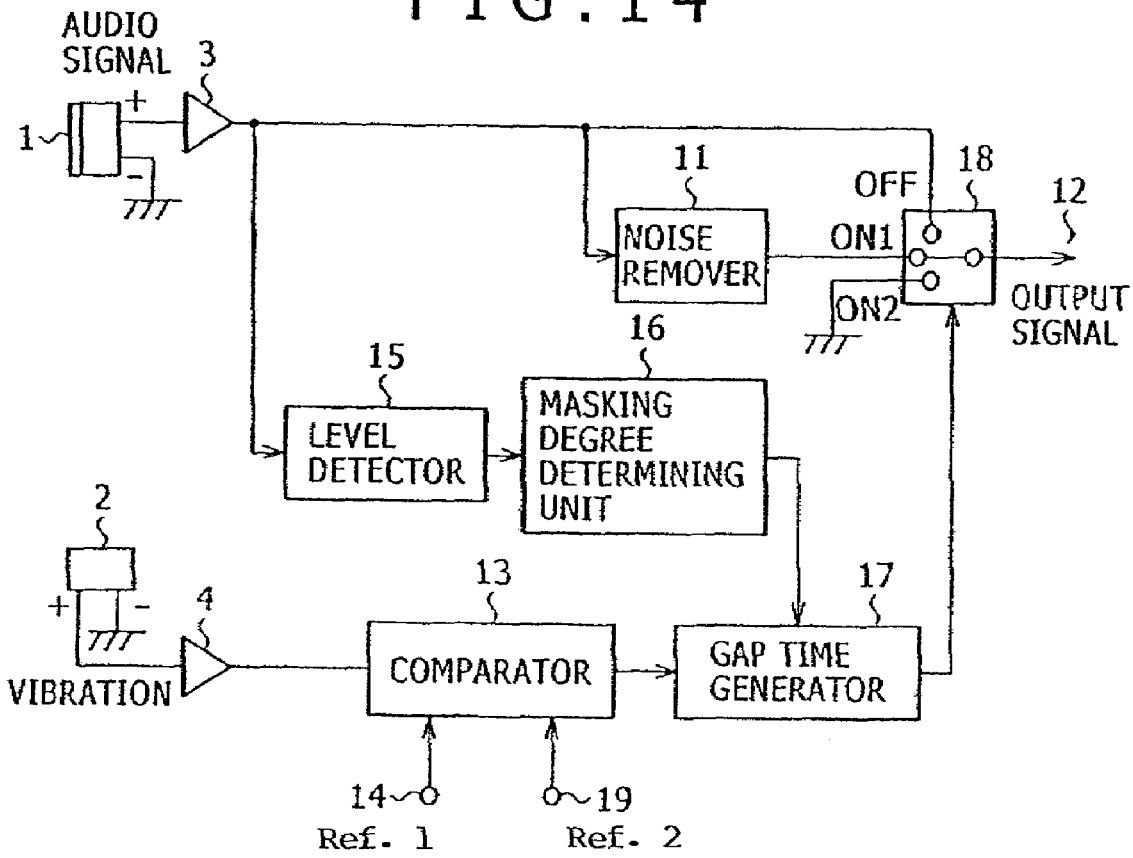
FIG. 14 is a block diagram of a seventh noise reduction system according to the present invention.

A seventh noise reduction system according to the present invention will be described below with reference to FIG. 14. Those functional blocks of the sixth noise reduction system shown in FIG. 14 which are identical to those of the second noise reduction system shown in FIG. 5 are denoted by identical reference characters, and will not be described in detail below. As shown in FIG. 14, an audio signal from the microphone 1 and a shock noise signal therefrom are supplied to the OFF terminal of the selector switch 18 and also supplied to the noise remover 11 that is connected to an ON1 terminal of the selector switch 18. The selector switch 18 has an ON2 terminal that is connected to the ground. The selector switch 18 selects one of the signals supplied to the OFF, ON1, and ON2 terminals thereof under the control of the gap time generator 17, and outputs the selected signal to terminal 12.

A vibration signal from the sensor 2 is supplied through the amplifier 4 to the comparator 13. The comparator 13 compares the vibration signal with a reference level 1 from the terminal 14 and a reference level 2 from a terminal 19, and outputs a result signal to the gap time generator 17. Based on the signal from the comparator 13, the gap time generator 17 generates a gap time depending on the masking degree that is determined by the masking degree determining unit 16 from the sound level detected by the level detector 15.

Figures 15A, 15B, 15C:
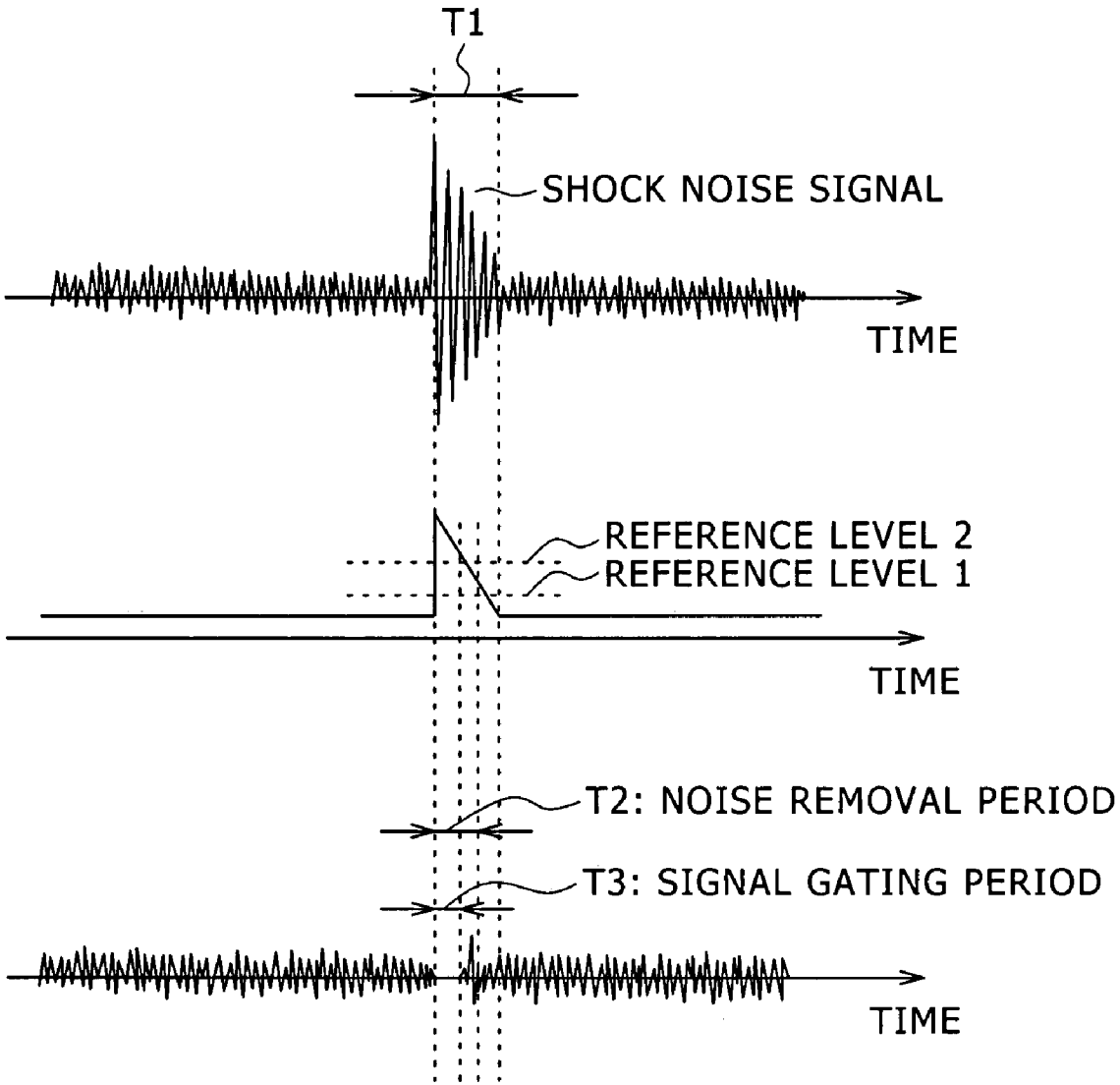
FIGS. 15A through 15C are diagrams illustrative of an example of noise reduction, FIG. 15A showing a target noise signal, FIG. 15B a sensor output signal, and FIG. 15C a noise-reduced signal.

An example of noise reduction which is carried out by the noise reduction system shown in FIG. 14 will be described below with reference to FIGS. 15A through 15C. FIG. 15A shows a target noise signal, FIG. 15B a sensor output signal, and FIG. 15C a noise-reduced signal.

As shown in FIG. 15A, a target noise signal including a shock noise signal having a noise producing period T1 is input from the microphone 1. Shock noise in synchronism with the shock noise signal is detected by the sensor 2, which outputs a sensor output signal as shown in FIG. 15B. The comparator 13 compares the sensor output signal with the reference level 1 and the reference level 2 which is higher than the reference level 1.

The comparator 13 sends a timing period in which the sensor output signal is higher than the reference level 1 as a noise removal period T2 to the gap time generator 17, and also sends a timing period in which the sensor output signal is higher than the reference level 2 as a signal gating period T3 to the gap time generator 17, which limits the noise removal period T2 and the signal gating period T3 within the masking period. Based on the noise removal period T2 and the signal gating period T3, the gap time generator 17 generates and outputs a gap time for shifting the selector switch 18 to the ON1 terminal in the noise removal period T2 and shifting the selector switch 18 to the ON2 terminal in the signal gating period T3 to produce the noise-reduced signal shown in FIG. 15C.

Therefore, the signal with the higher noise level is gated off, and the signal with the lower noise level is subjected to noise removal, so that the seventh noise reduction system offers a combination of advantages of the first and second noise reduction systems.

Figure 16:
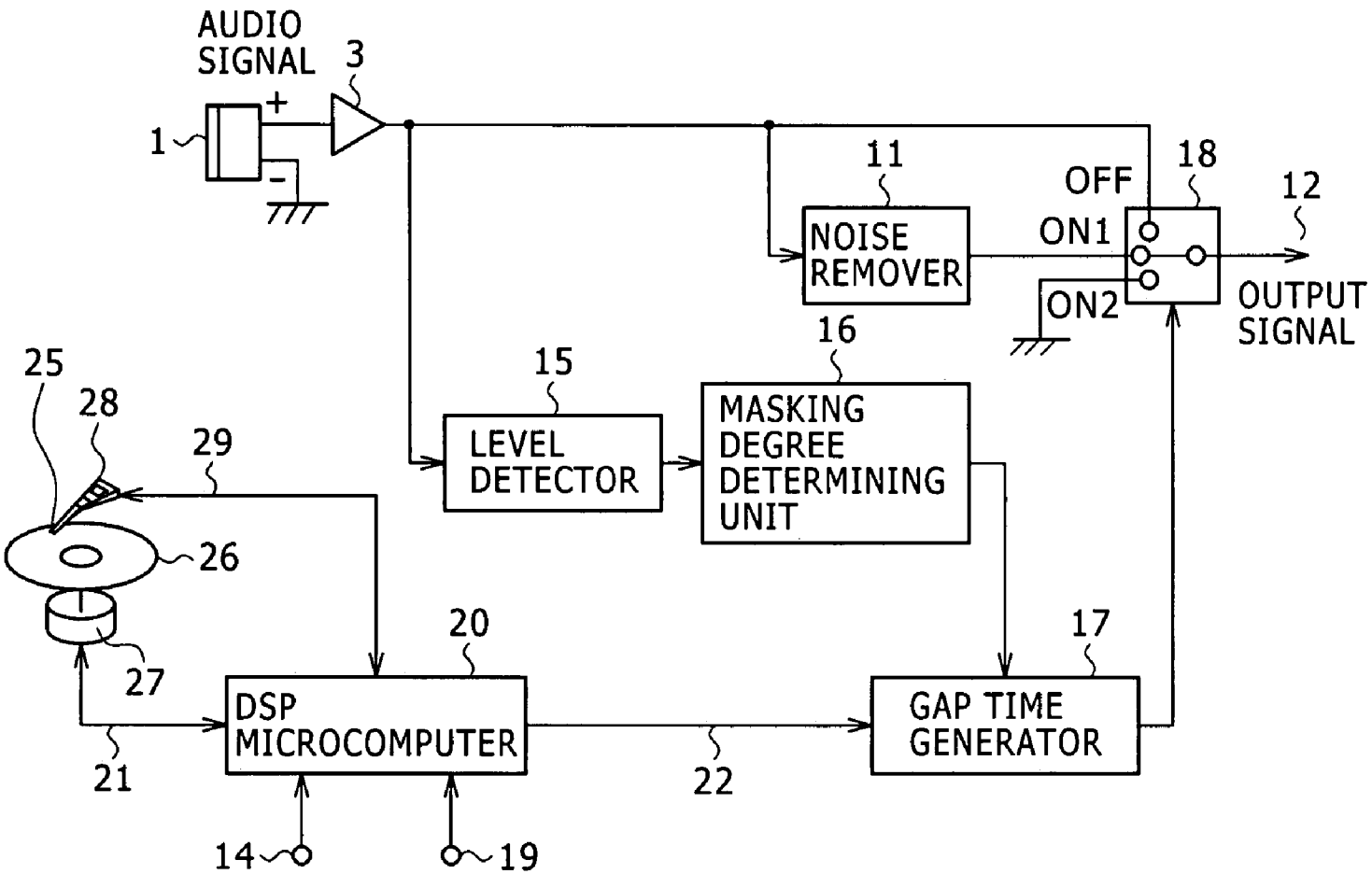
FIG. 16 is a block diagram of an eighth noise reduction system according to the present invention.

FIG. 16 shows an eighth noise reduction system according to the present invention. The eighth noise reduction system may be used for noise removal in the seek mode on hard disk 26 as with the third noise reduction system described above. In FIG. 16, the DSP microcomputer 20 establishes an acceleration/deceleration period in the seek mode in which the noise level is high as a timing period 2, and other noise producing period as a timing period 1. The DSP microcomputer 20 sends the timing period 2 as a signal gating period and the timing period 1 as a noise removal period to the gap time generator 17, which limits the signal gating period and the noise removal period within the masking period. In the noise removal period, the gap time generator 17 shifts the selector switch 18 to the ON1 terminal for noise reduction. In the signal gating period, the gap time generator 17 shifts the selector switch 18 to the ON2 terminal for noise reduction.

Although certain preferred embodiments of the present invention have been shown and described in detail, it should be understood that various changes and modifications may be made therein without departing from the scope of the appended claims.

What is claimed is:

1. An apparatus for reducing noise in an input audio signal, comprising:

at least one audio signal inputting section;

a noise timing generator for generating a noise timing signal corresponding to a noise producing period of noise introduced from a noise source and contained in said audio signal;

a noise remover for removing the noise from said audio signal;

a switch for selectively outputting said audio signal and a signal from said noise remover;

a level detector for detecting a signal level of said audio signal; and a masking degree determining unit for determining a gap period for which the audio signal is masked by the human auditory system from the signal level detected by said level detector;

wherein said switch outputs the signal from said noise remover in a period corresponding to said gap period within the noise producing period of said noise timing signal, and outputs said audio signal in other than said gap period.

2. The apparatus according to claim 1, wherein said audio signal inputting section for inputting the audio signal comprises a microphone.

3. The apparatus according to claim 1, wherein said noise timing generator uses a period for which a detected noise signal from a sensor is equal to or higher than a predetermined level, as the noise producing period.

4. The apparatus according to claim 1, wherein said noise timing generator generates the noise timing signal corresponding to the noise producing period based on a drive signal for driving said noise source.

5. The apparatus according to claim 1, wherein said noise remover eliminates the signal level of said audio signal to zero.

6. The apparatus according to claim 1, wherein said noise remover comprises a filter for removing the frequency band of the noise.

7. The apparatus according to claim 1, wherein said switch comprises a cross-fading switching unit.

8. A method of reducing noise in an input audio signal, comprising the steps of:

generating a noise timing signal corresponding to a noise producing period of noise introduced from a noise source and contained in at least one audio signal;

removing the noise from said audio signal;

selectively outputting said audio signal and a signal from said noise removing step;

detecting a signal level of said audio signal; and determining from the signal level detected by said signal level detecting step a gap period for which the audio signal is masked by the human auditory system;

wherein said selectively outputting step outputs the signal from said noise removing step in a period corresponding to said gap period within the noise producing period of said noise timing signal, and outputs said audio signal in other than said gap period.

9. An apparatus for reducing noise in an input audio signal, comprising:

at least one audio signal inputting section;

a band divider for dividing said audio signal into a plurality of audio signals in respective bands;

a noise timing generator for generating a noise timing signal corresponding to a noise producing period of noise introduced from a noise source and contained in said audio signals from said band divider;

a plurality of noise remover for removing the noise from said audio signals, respectively;

a plurality of switch for selectively outputting said audio signal and signals from said noise remover;

a plurality of level detector for detecting signal levels of said audio signals; and a plurality of masking degree determining unit for determining gap periods for which the audio signals are masked by the human auditory system from the signal levels detected by said level detector;

wherein said switch outputs the signals from said noise remover in periods corresponding to said gap periods within the noise producing period of said noise timing signal, and outputs said audio signal in other than said gap periods, the audio signals in the respective bands are added into a sum signal, and the sum signal is outputted.

10. The apparatus according to claim 9, wherein said audio signal inputting section for inputting the audio signal comprises a microphone.

11. The apparatus according to claim 9, wherein said noise timing generator uses a period for which a detected noise signal from a sensor is equal to or higher than a predetermined level, as the noise producing period.

12. The apparatus according to claim 9, wherein said noise timing generator generates the noise timing signal corresponding to the noise producing period based on a drive signal for driving said noise source.

13. The apparatus according to claim 9, wherein said noise remover eliminates the signal level of said audio signal to zero.

14. The apparatus according to claim 9, wherein said noise remover comprises a filter for removing the frequency band of the noise.

15. The apparatus according to claim 9, wherein said switch comprises a cross-fading switching unit.

16. A method of reducing noise in an input audio signal, comprising the steps of:

dividing at least one audio signal into a plurality of audio signals in respective bands;

generating a noise timing signal corresponding to a noise producing period of noise introduced from a noise source and contained in said audio signals from said dividing step;

removing the noise from said audio signals;

selectively outputting said audio signal and signals from said noise removing step;

detecting signal levels of said audio signals; and determining from the signal levels detected by said level detecting step gap periods for which the audio signals are masked by the human auditory system;

wherein said selectively outputting step outputs the signals from said noise removing step in periods corresponding to said gap periods within the noise producing period of said noise timing signal, and outputs said audio signal, adds the audio signals in the respective bands into a sum signal, and outputs the sum signal in other than said gap period.

17. An apparatus for reducing noise in an input audio signal, comprising:

a plurality of microphones;

a processing section for outputting a differential component between a plurality of audio signals from said microphones;

a noise extractor for extracting noise introduced from a noise source and contained in an output signal from said processing section;

a noise timing generator for generating a noise timing signal corresponding to a noise producing period of said noise;

a noise remover for removing the noise from said audio signals;

a switch for selectively outputting said audio signal and a signal from said noise remover;

a level detector for detecting a signal level of said audio signals; and a masking degree determining unit for determining a gap period for which the audio signals are masked by the human auditory system from the signal level detected by said level detector;

wherein said switch outputs the signal from said noise remover in a period corresponding to said gap period within the noise producing period of said noise timing signal, and outputs said audio signals in other than said gap period.

18. The apparatus according to claim 17, wherein said noise remover eliminates the signal level of said audio signal to zero.

19. The apparatus according to claim 17, wherein said noise remover comprises a filter for removing the frequency band of the noise.

20. The apparatus according to claim 17, wherein said switch comprises a cross-fading switching unit.

21. A method of reducing noise in an input audio signal, comprising the steps of:

outputting a differential component between a plurality of audio signals from a plurality of microphones;

extracting noise introduced from a noise source and contained in an output signal from said processing step;

generating a noise timing signal corresponding to a noise producing period of said noise;

removing the noise from said audio signals;

selectively outputting said audio signal and a signal from said noise removing step;

detecting a signal level of said audio signals; and determining from the signal level detected by said level detector a gap period for which the audio signals are masked by the human auditory system;

wherein said selectively outputting step outputs the signal from said noise removing step in a period corresponding to said gap period within the noise producing period of said noise timing signal, and outputs said audio signals in other than said gap period.

22. A method of reducing noise in an input audio signal, comprising the steps of:

generating a noise timing signal corresponding to a noise producing period of noise introduced from a noise source and contained in at least one audio signal;

removing a noise band from said audio signal;

gating off noise from said audio signal;

selectively outputting said audio signal, a signal from said noise removing step, and a signal from said noise gating-off step;

detecting a signal level of said audio signal; and determining from the signal level detected by said signal level detecting step a gap period for which the audio signal is masked by the human auditory system;

wherein said noise timing signal is generated by a first timing detecting process for detecting a first timing at which the noise is equal to or higher than a first noise level and the noise is equal to or lower than a second noise level in the noise producing period, and a second timing detecting process for detecting a second timing at which the noise exceeds the second noise level; and wherein in a period corresponding to said gap period within the noise producing period, including said first timing and said second timing, of said noise timing signal, said selectively outputting step outputs the signal from said noise removing step at said first timing, outputs the signal from said noise gating-off step at said second timing, and outputs said audio signal in other than said gap period.

* * * * *